US007199763B2

(12) United States Patent
Bryan, Jr. et al.

(10) Patent No.: US 7,199,763 B2
(45) Date of Patent: Apr. 3, 2007

(54) GROUND PROXIMITY ANTENNA SYSTEM

(75) Inventors: John W. Bryan, Jr., Bellingham, MA (US); Lawrence Paul Drury, III, Mattapoisett, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 26 days.

(21) Appl. No.: 11/120,158

(22) Filed: May 2, 2005

(65) Prior Publication Data

US 2005/0243014 A1 Nov. 3, 2005

Related U.S. Application Data

(60) Provisional application No. 60/567,695, filed on May 3, 2004.

(51) Int. Cl.
*H01Q 1/34* (2006.01)

(52) U.S. Cl. ..... 343/709; 343/895

(58) Field of Classification Search ..... 343/895, 343/797, 742, 867, 866, 741, 872, 709
See application file for complete search history.

(56) References Cited

U.S. PATENT DOCUMENTS

| | | | | |
|---|---|---|---|---|
| 2,581,444 | A | 1/1952 | Richardson et al. | |
| 3,312,902 | A | 4/1967 | Dean et al. | |
| 3,820,117 | A * | 6/1974 | Hall et al. | 343/802 |
| 3,946,391 | A | 3/1976 | Cuckler et al. | |
| 3,965,512 | A | 6/1976 | Bennett et al. | |
| 3,972,046 | A | 7/1976 | Lombardi | |
| 4,083,051 | A | 4/1978 | Woodward | |
| 4,180,820 | A | 12/1979 | Johns | |
| 4,216,535 | A | 8/1980 | Bennett | |
| 4,434,425 | A | 2/1984 | Barbano | |
| 4,475,109 | A | 10/1984 | Dumas et al. | |
| 5,187,488 | A | 2/1993 | Van Der Vis | |
| 5,456,427 | A | 10/1995 | Greenhalgh | |
| 5,534,882 | A | 7/1996 | Lopez | |
| 5,566,908 | A | 10/1996 | Greenhalgh | |
| 5,764,195 | A | 6/1998 | Colclough et al. | |
| 6,014,107 | A | 1/2000 | Wiesenfarth | |
| 6,133,891 | A | 10/2000 | Josypenko | |
| 6,417,816 | B2 | 7/2002 | Sadler et al. | |
| 6,426,464 | B1 | 7/2002 | Spellman et al. | |
| 6,512,496 | B2 * | 1/2003 | Alexeff et al. | 343/915 |

(Continued)

OTHER PUBLICATIONS

Karlsson et al., "An integrated spiral antenna system for UWB," *University of Linköping, Department of Science and Technology—ITN, LiU Norrköping*, Accepted for publication in the "European Microwave Week 2005," Paris, 3 pgs.

(Continued)

*Primary Examiner*—Hoanganh Le
(74) *Attorney, Agent, or Firm*—Goodwin Procter LLP

(57) ABSTRACT

The invention provides an antenna system for operation near a ground plane, for example, at or near the surface of a body of water. The antenna system includes, for example, an array of filar elements attached to one or more spiral elements. The system also includes, for example, a buoyant support and/or housing for transporting the antenna to and/or maintaining the antenna at or near the surface of a body of water.

38 Claims, 9 Drawing Sheets

U.S. PATENT DOCUMENTS

| | | | | |
|---|---|---|---|---|
| 6,515,628 | B2 | 2/2003 | Roberts | |
| 6,542,128 | B1 * | 4/2003 | Johnson et al. | 343/742 |
| 6,618,016 | B1 | 9/2003 | Hannan et al. | |
| 6,657,580 | B1 | 12/2003 | Edwards et al. | |
| 6,711,095 | B1 | 3/2004 | Daniels | |
| 2005/0088337 | A1 | 4/2005 | Lorenz | |
| 2005/0259017 | A1 * | 11/2005 | Yegin et al. | 343/728 |

OTHER PUBLICATIONS

FAS Military Analysis Network AN/BRT-6 Sources and Resources, http://www.fas.org/man/dod-101/sys/ship/weaps/an-brt-6.ht (downloaded Jul. 12, 2005), 2 pgs.

Design and construction of quadrifilar helicoidal antennas, http://www.jcoppens.com/ant/qfh/index.en.php, (downloaded Jul. 12, 2005), 3 pgs.

Sketch of BRT-6 Antenna design, date unknown.

* cited by examiner

GROUND PROXIMITY ANTENNA SYSTEM

PRIOR APPLICATIONS

This application claims the benefit of U.S. Provisional Patent Application Ser. No. 60/567,695, filed May 3, 2004, the text of which is hereby incorporated by reference in its entirety.

FIELD OF THE INVENTION

The present invention relates generally to antenna systems. More particularly, in certain embodiments, the invention relates to a broadband antenna system that provides advantageous radiation characteristics while operating in close proximity to a ground plane.

BACKGROUND OF THE INVENTION

When a circularly polarized antenna is operated in close proximity to a ground plane, such as the surface of a body of water, energy radiated from the antenna array is reflected by the ground plane and may result in destructive interference. Performance characteristics of the antenna system, such as axial ratio and circular polarization (CP) gain, are negatively impacted by such interference.

Antenna systems for use on the surface of a body of water may be deployed from ships, submarines, or airplanes. It is generally desired that the antenna systems stowed on board take up as little volume as possible. Moreover, it may be desired that the volume occupied by antenna arrays during operation near a ground plane be minimized, for example, in order to avoid detection by unauthorized persons. Furthermore, it may be costly to retrieve such antenna systems, once deployed in the sea.

There exists a need for an antenna system with improved performance characteristics when operated in close proximity to a ground plane. It is further desired that such an antenna system occupy a suitably low volume and that the system be cost-efficient enough for expendable use.

SUMMARY OF THE INVENTION

The invention provides an antenna system that demonstrates advantageous axial ratio performance and/or hemispherical gain performance during operation near a ground plane. Furthermore, in certain embodiments, the antenna system features a flexible antenna array within an inflatable housing that transports and maintains the antenna system at or near the surface of a body of water. The antenna system may be stowed on board a ship or submarine with its housing uninflated, thereby conserving space prior to deployment.

One aspect of the invention provides an antenna system adapted for operation near a ground plane that yields advantageous performance characteristics. The antenna system comprises an antenna array and a support for the antenna array. The antenna array includes a plurality of filar (i.e. wire or wire-like) elements, as well as one or more spiral elements connected to one or more (or each) of the filar elements. The inclusion of the spiral element(s) has the effect of providing improved axial ratio and overhead gain with only minor impact on low angle performance, all without substantially increasing the volume occupied by the antenna array (if at all).

In a preferred embodiment, a first length of each of the filar elements extends radially toward a first point on a central vertical axis. The first length of each of the filar elements may be straight and/or may lie in substantially the same plane as the spiral element. Alternatively, the first length may be curved. For example, the filar elements of the antenna system may form a domed shape, where the first length of each of the filar elements extends radially in an arc toward a substantially planar spiral element. The spiral element, itself, is preferably substantially planar, but may alternatively form a three-dimensional, spring-like shape.

In one embodiment, the antenna array comprises four filar elements and the spiral element is a quadrifilar spiral element centered about a point on the central vertical axis. For example, the spiral element may be an integral Left Hand Circular Polarization (LHCP) or Right Hand Circular Polarization (RHCP) element. In an alternative embodiment, the spiral element is bifilar and is attached to two filar elements. In a further alternative embodiment, the spiral element is monofilar or trifilar. The spiral element may or may not be attached to all of the filar elements of a given antenna array.

The spiral element is preferably open-ended and, in one embodiment, the spiral element forms a fractional turn, for example, a ¼, ½, or ¾ turn (or any other fraction less than 1). In alternative embodiments, the spiral forms a single, double, or triple turn, or some fraction in-between. An open-ended spiral element forms a gap at its center. For example, the gap at the center of an open-ended 2.5-inch diameter spiral is preferably about 0.2 inch. In one embodiment, the gap is anywhere from about 0.05 inch to about 0.9 inch, preferably from about 0.1 inch to about 0.3 inch, and more preferably from about 0.15 inch to about 0.25 inch. The gap may be scaled with the size of the spiral, for example. Furthermore, the spiral element may be scaled with a dimension of the antenna array, for example. In one embodiment, a 2.5-inch diameter spiral is used where the antenna array is about 10 inches in diameter and about 11 inches high. Alternative embodiments include antenna arrays whose elements have different dimensions than described herein, for example, arrays having absolute dimensions different than those described herein, as well as arrays having elements whose dimensions relative to each other are different than as described herein. The length of the filar elements and the dimensions of the spiral element(s) may be scaled as a function of desired frequency of operation, with lower frequencies generally requiring longer length filar elements and larger diameter spiral element(s) and higher frequencies requiring shorter length filar elements and smaller diameter spiral element(s). In one embodiment, the dimensions of one or more elements of the antenna array are scaled by a ratio of frequencies.

In one embodiment, the antenna array has a top and a bottom in relation to a ground plane, and there is preferably a spiral element at the top. There may be an additional spiral element at the bottom. The antenna array may be an end-fed or a center-fed array, for example. Where the antenna array includes only one spiral element, the antenna array is preferably end-fed, and where the antenna array includes a spiral element at both its top and its bottom, the antenna array can be end- or center-fed, for example. In alternative embodiments, there may be three, four, five, or more spiral elements.

In one embodiment, the antenna support is buoyant, for example, so that the antenna array is capable of performing substantially at or near the surface of a body of water (i.e. a seawater or freshwater ground plane). For example, the support may be adapted to inflate upon being deployed from a subsurface position, such that the antenna array is transportable to (or near) a seawater (or freshwater) ground plane. This provides the further benefit of compact storage in a submarine prior to deployment of the antenna system. Alternatively, the support may include, for example, a buoyant foam material, or a rigid buoyant or non-buoyant support made from other dielectric materials. In one embodiment, the antenna array is fabricated from rigid, self-supporting conductive elements. In one embodiment, the support at least partially fills a region defined by the array. In one embodiment, at least a portion of the volume occupied by the array is cylindrical, polyhedral, spherical, or hemispherical in shape.

It is found that improvement in gain, for example RHCP gain, can be achieved by maintaining the bottom of the array slightly above the water surface. Accordingly, in one embodiment, the support is adapted to maintain the bottom of the array at a position slightly above the ground plane, for example, from about 0.2 inch to about 6 inches above the ground plane, from about 2 inches to about 4 inches above the ground plane, or at about 3 inches above the ground plane. The height above the water may be scaled with respect to the dimension(s) of one or more elements of the antenna array and/or with respect to the desired frequency (ies) of operation.

Additionally, the antenna array may be flexible so as to allow compact storage prior to being deployed. For example, the antenna array may be fabricated as a foldable and/or flexible structure that is housed in an inflatable bag. Thus, the antenna system may be compacted prior to use, and then may be deployed for use by inflating the bag. If deployment begins under water, the buoyant inflated bag antenna support may be adapted to raise the antenna array to the surface and maintain the antenna array upright on the water surface (or slightly above the water surface) for use. The antenna support, and/or a mechanism therein, may also be adapted to orient the antenna array in an ideal operating position, for example, with respect to the ground plane, after deployment of the antenna array to the water surface. In one embodiment, desired orientation is accomplished by electronic and/or mechanical adjustment, and may be performed remotely. In one embodiment, desired orientation is accomplished by weighting of the antenna system and/or by virtue of the shape of the antenna system.

In one embodiment, the antenna system is adapted to operate at least over a 250 MHz to 270 MHz receive band and a 290 MHz to 310 MHz transmit band. Operation over different receive and/or transmit bands is also contemplated.

In another aspect, the invention provides an antenna (i.e. with or without a support) that includes a plurality of generally C-shaped, filar elements orbitally disposed about a central vertical axis. The antenna may include two, three, four, five, six, or more filar elements. A first spiral element is centered substantially at a first point on a central vertical axis. The first spiral element is connected to one or more (or each) of the filar elements. The connection may be direct or indirect. An example of an indirect connection between a filar element and a spiral element includes the case where a first filar element that is not directly connected to a spiral element touches a second filar element that is directly connected to the spiral element. In one embodiment, the antenna comprises a second spiral element centered substantially at a second point on the central vertical axis, and connected to each of the filar elements.

Various possible configurations and/or sizes of elements of the antenna (with or without support) include those described with respect to the antenna system described herein above. The plurality of filar elements of the antenna may define a substantially cylindrical volume. The plurality of filar elements may alternatively define a substantially polyhedral volume. In one embodiment, the C-shaped filar elements are curved, and in another embodiment, the C-shaped filar elements are in the shape of a block-C (i.e. with approximately 90-degree angles). The antenna may include a mix of both curved and block C-shaped filar elements. The antenna, in one embodiment, forms a hemispherical shape such that each of the generally C shaped filar elements is a "half-C" shape.

In yet another aspect, the invention provides an antenna system deployable from a subsurface position for operation near a ground plane, the system including a flexible antenna array and an inflatable housing containing the antenna array, the housing adapted to inflate upon being deployed from a subsurface position such that the antenna array is transportable to (or near) the surface of a body of water. In one embodiment, the flexible antenna array comprises two or more filar elements and a spiral element connected to at least one of the filar elements. In one embodiment, the inflatable bag of the antenna system is adapted to maintain the bottom of the array at a position slightly above the ground plane, for example, from about 0.2 inch to about 6 inches above the ground plane (i.e. surface of the water). Various possible configurations and/or sizes of the elements of the antenna include those mentioned herein above and further described elsewhere herein.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DESCRIPTION OF THE ILLUSTRATIVE EMBODIMENT

The invention provides an antenna system adapted for operation near a ground plane that yields advantageous performance characteristics. The antenna system includes an antenna array having two or more filar (i.e. wire-like) elements, as well as one or more spiral elements. The inclusion of the spiral element(s) has the effect of providing improved axial ratio and overhead gain with only minor impact on low angle performance, all without substantially increasing the volume occupied by the antenna array (if at all).

Figure 1A:
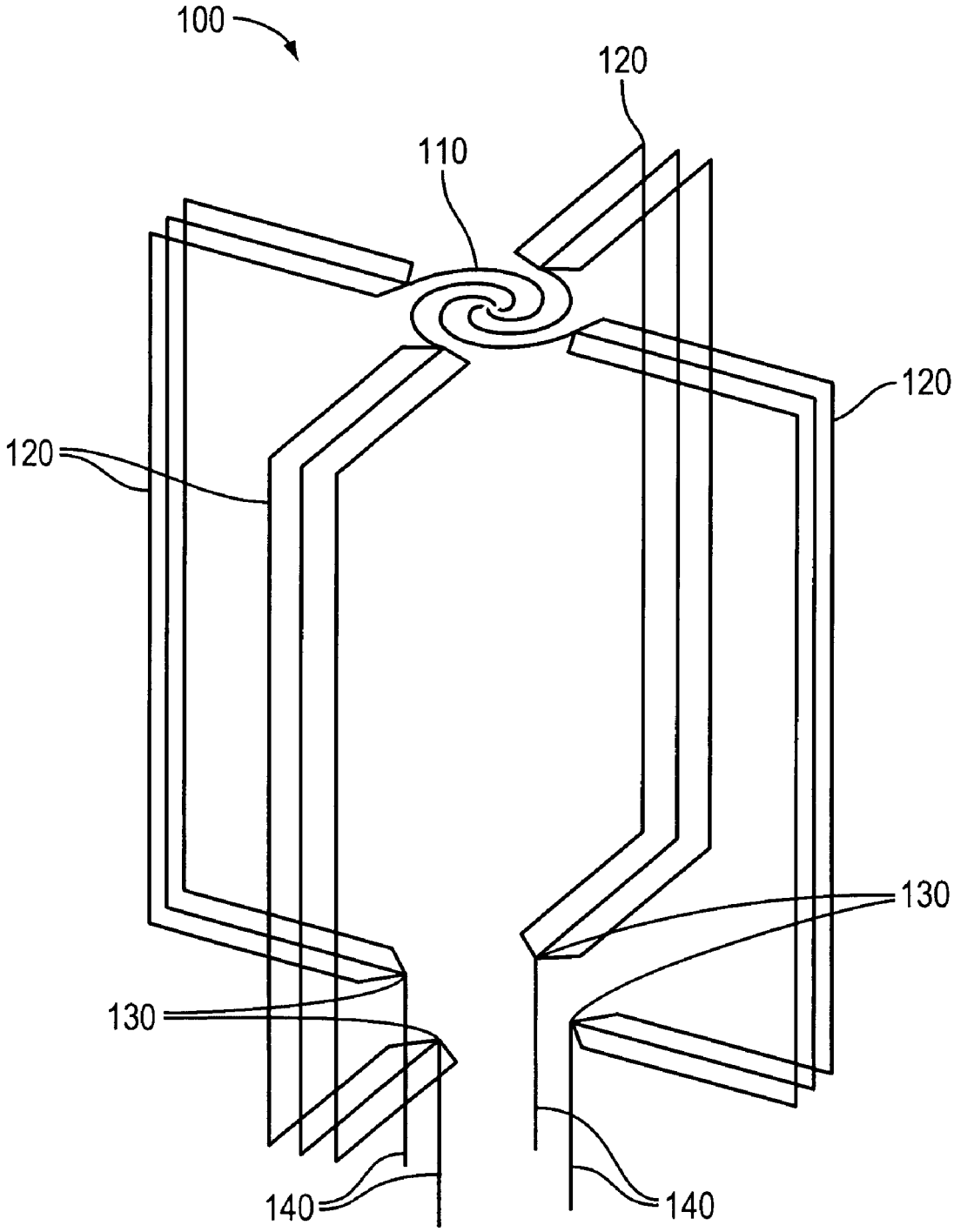
FIG. 1A is a schematic perspective view of an antenna array forming a substantially cylindrical shape and featuring a spiral element at the top of the array, according to an illustrative embodiment of the invention.

FIGS. 1A shows a schematic representation of one embodiment of the antenna array. In FIG. 1A, the antenna array 100 includes a spiral element 110 located at the top of the array 100 and centered at a point along a central vertical axis. The spiral element 110 is a quadrifilar spiral element 110 and may be, for example, an integral Left Hand Circular Polarization (LHCP) or Right Hand Circular Polarization (RHCP) element.

Each distal end of the quadrifilar spiral element 110 connects to a filar element 120. In this embodiment, the four filar elements 120 extend radially from the spiral element 110 along the horizontal plane, for a certain distance. These filar elements 120, and the quadrifilar spiral element 110, can be made, for example, from copper or other suitable conductive material, including, but not limited to, gold, silver, brass, nickel, aluminum, tin, various naval bronzes, carbon steel, stainless steel, titanium, conductive plastics and composites. At a certain radial distance, the filar elements 120 are bent such that a length of each element extends in a direction substantially parallel to the central vertical axis. At a certain height, each of the filar elements 120 is bent at the bottom of the array to extend radially toward the central vertical axis in a substantially horizontal manner. As such, each filar element 120 defines a substantially block C-shaped component. Each filar element 120 at the bottom of the array ends 130 at a certain distance from the central vertical axis, for example, at a distance approximately equal to the radius of the spiral element 110 at the top of the array. As described herein, the bottom of the array is assumed to be defined by the location of the ends 130 of the filar elements 120.

The ends of the filar elements 120 are attached to connection elements 140 that connect the antenna array to the matching networks and associated electronics of the array. For example, these electronics may be mounted within a housing placed underneath the antenna array 100. In certain embodiments, the connection elements 140 may be made from the same material as the quadrifilar spiral element 110 and a filar element 120 (e.g., copper). In alternative embodiments, other connectors, such as, but not limited to, co-axial cable, may be used for the connection elements 140.

Figure 1B:
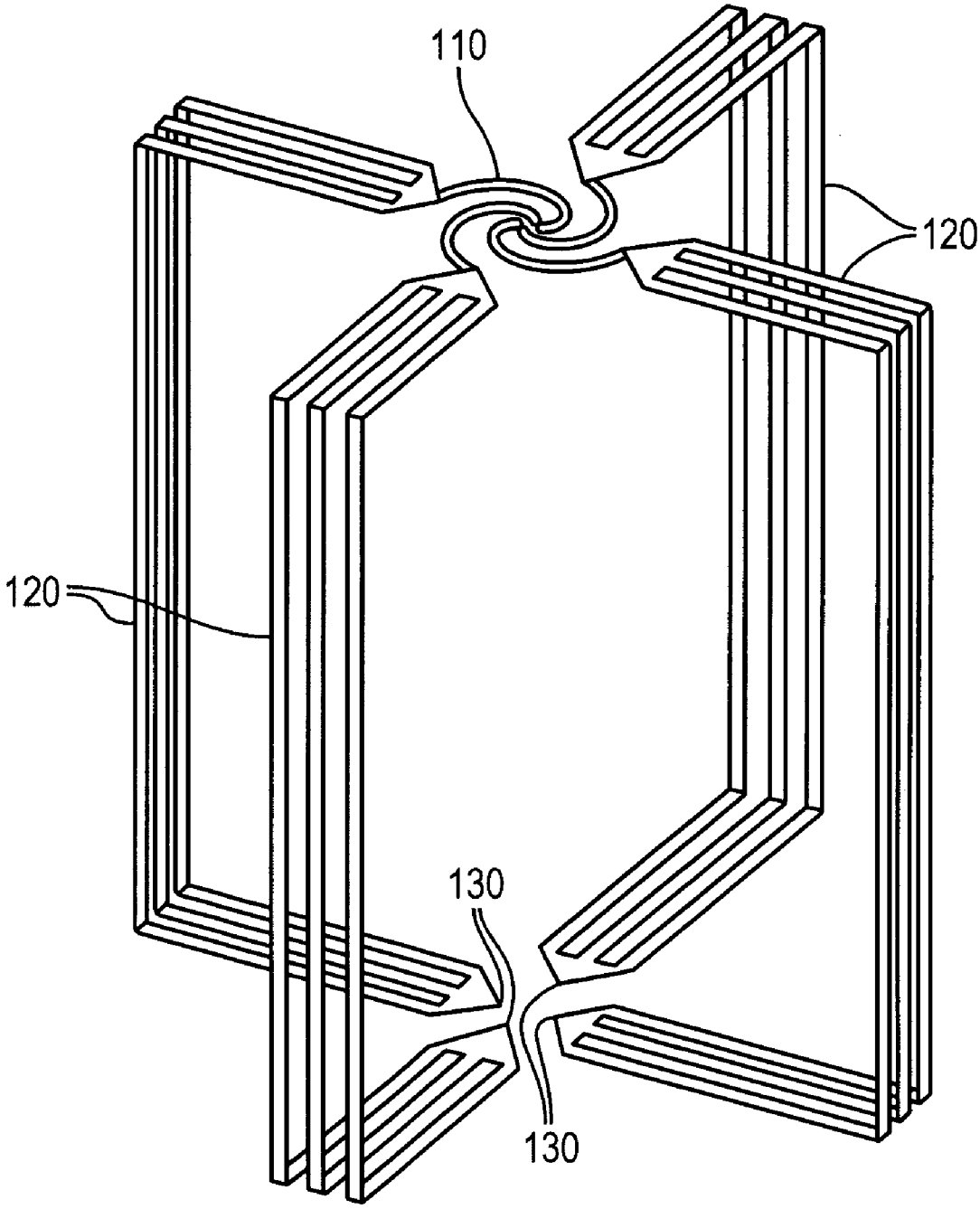
FIG. 1B is a schematic perspective view of the antenna of FIG. 1A, with an alternative connection at the bottom of the antenna array, according to an illustrative embodiment of the invention.

FIG. 1B shows a similar antenna array with an alternative arrangement of the ends 130 of the filar elements 120 at the bottom of the array. In this embodiment, the quadrifilar spiral element 110 and four filar elements 120 are arranged in substantially the same manner as in FIG. 1A. However, in this embodiment, the ends 130 of each filar element 120 extend horizontally further inward toward the central vertical axis. In an example embodiment, the ends 130 of each filar element 120 are located a radial distance of about 0.5 inches from the central vertical axis, although in alternative embodiments this distance may be greater or smaller. A number of connection elements may attach to the ends 130 of the filar elements 120 to link the array to the electronics. These connection elements may include, for example, copper wire, co-axial cable, or other suitable material.

In alternative embodiments, the spiral element may be made up of 2 curved wires attached to two filar elements of the array. In further embodiments, the spiral element may be made up of 1, 3, 4, 5, or more curved wires. The spiral element may or may not be attached to all of the filar elements of a given antenna array. The array may, in certain embodiments, include a greater or smaller number of filar elements 120. In certain embodiments, the filar elements 120 may be spaced at regular intervals around the central vertical axis, although in other embodiments the angle between certain filar elements 120 may be different. These elements may be configured to extend horizontally outward from the central vertical axis at the top and bottom of the array, extend at an angle to the central vertical axis, or curve out from the central vertical axis, for example.

The spiral element 110 may be open-ended and, in one embodiment, the spiral element 110 forms a fractional turn, for example, a ¼, ½, or ¾ turn. In alternative embodiments, the spiral can form a single, double, or triple turn, or some fraction in-between. An open-ended spiral element forms a gap at its center. For example, the gap at the center of an open-ended 2.5 inch diameter spiral may be about 0.2 inch. In certain embodiments, the gap is anywhere from about 0.05 inch to about 0.9 inch, preferably from about 0.1 inch to about 0.3 inch, and more preferably from about 0.15 inch to about 0.25 inch. The gap may be scaled with the size of the spiral, for example. Furthermore, the spiral element may be scaled with a dimension of the antenna array, for example. In one embodiment, a 2.5 inch diameter spiral is used where the antenna array is about 10 inches in diameter and about 11 inches high. Alternative embodiments include antenna arrays whose elements have different dimensions than described herein, for example, arrays having absolute dimensions different than those described herein, as well as arrays having elements whose dimensions relative to each other are different than as described herein. The length of the filar elements and the dimensions of the spiral element(s) may be scaled as a function of desired frequency of operation, with lower frequencies generally requiring longer length filar elements and larger diameter spiral element(s) and higher frequencies requiring shorter length filar elements and smaller diameter spiral element(s). In one embodiment, the dimensions of one or more elements of the antenna array are scaled by a ratio of frequencies.

In one embodiment, the antenna array has a top and a bottom in relation to a ground plane, and there is preferably a spiral element at the top. There may be an additional spiral element at the bottom. The antenna array may be an end-fed or a center-fed array, for example. Where the antenna array includes only one spiral element, the antenna array is preferably end-fed, and where the antenna array includes a spiral element at both its top and its bottom, the antenna array may be end-fed or center-fed, for example. In alternative embodiments, there may be three, four, five, or more spiral elements.

Figure 2:
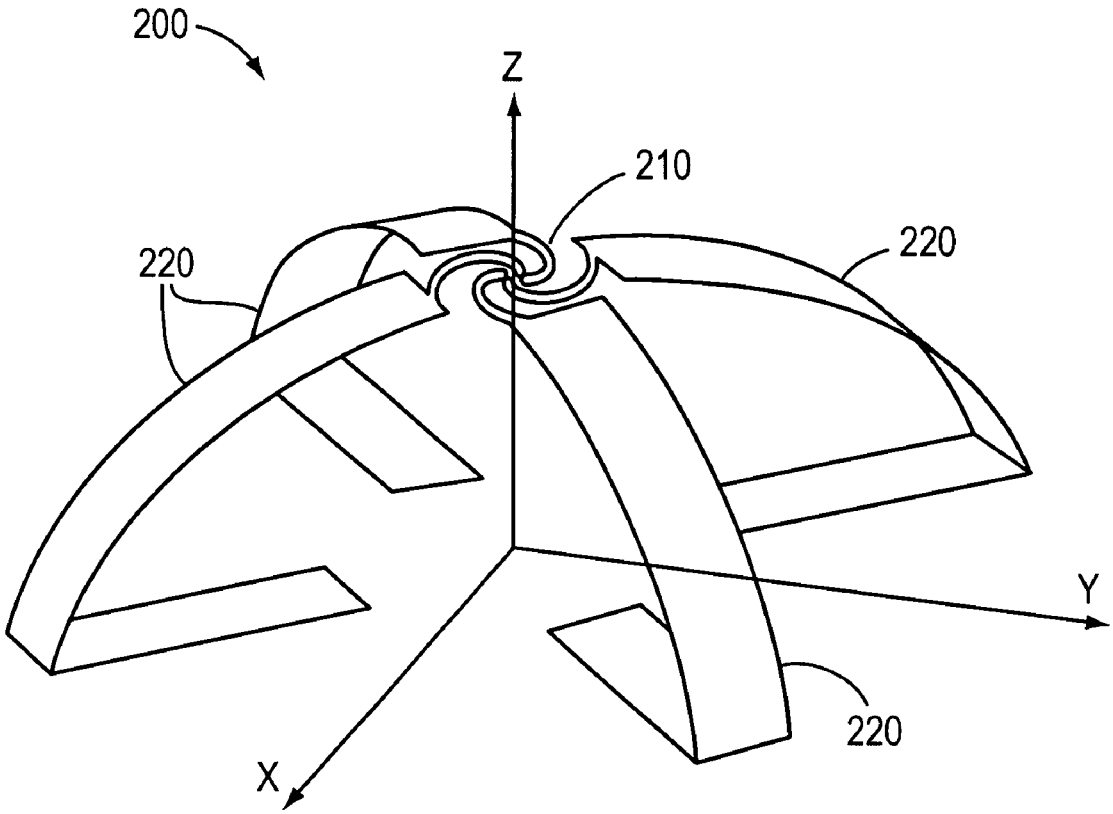
FIG. 2 is a schematic perspective view of an antenna array forming a substantially hemispherical shape, according to an illustrative embodiment of the invention.

FIG. 2 shows an example embodiment of an antenna array 200 with filar elements 220 forming a domed shape, where a length of each of the filar elements extends radially toward a substantially planar spiral element 210. The spiral element, itself, is preferably substantially planar, but may alternatively form a three-dimensional, spring-like shape. The antenna array 200 may be connected to associated electronics as described herein for the arrays of FIGS. 1A and 1B.

In one embodiment, the antenna support is buoyant, for example, so that the antenna array is capable of performing at or near a seawater (or freshwater) ground plane. For example, the support may be adapted to inflate upon being deployed from a subsurface position, such that the antenna array is transportable to a seawater ground plane. Alternatively, the support may include, for example, a buoyant foam material, or a rigid buoyant or non-buoyant support made from other dielectric materials. In one embodiment, the antenna array is fabricated from rigid, self-supporting conductive elements. In one embodiment, the support at least partially fills a region defined by the array. In one embodiment, the volume occupied by the array is cylindrical, polyhedral, spherical, or hemispherical in shape.

Additionally, the antenna array may be flexible so as to allow compact storage prior to being deployed. For example, the antenna array may be fabricated as a flexible structure that is housed in an inflatable bag. Thus, the antenna system may be compacted prior to use, and then may be deployed for use by inflating the bag. If deployment begins under water, the buoyant inflated bag antenna support may be adapted to raise the antenna array to the surface and maintain the antenna array upright on the water surface for use. The antenna support may also be adapted to orient the antenna array in an ideal operating position with respect to the ground plane, after deployment of the antenna array to the water surface. This may be accomplished, for example, by weighting of the antenna system and/or by virtue of the shape of the antenna system.

Figure 3A:
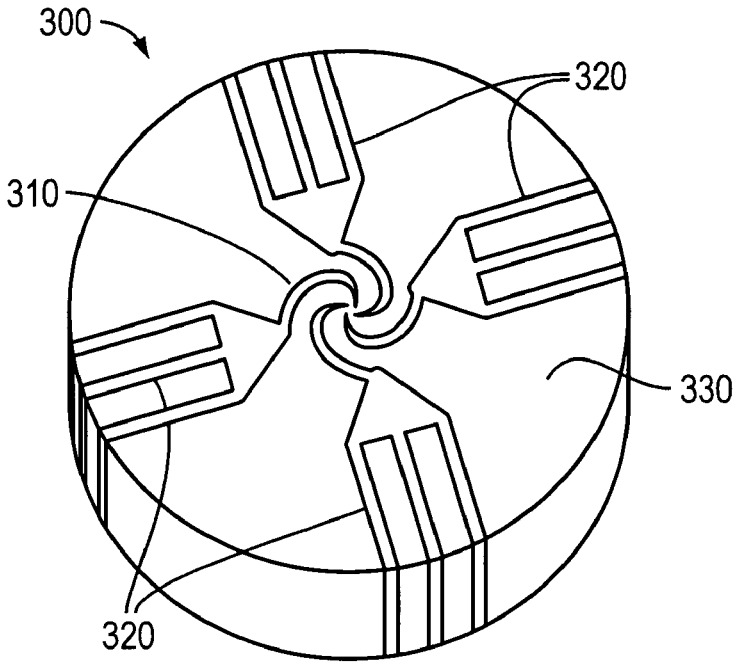
FIG. 3A is a top view photograph of an antenna system with an antenna array positioned about a solid cylindrical support, according to an illustrative embodiment of the invention.
Figure 3B:
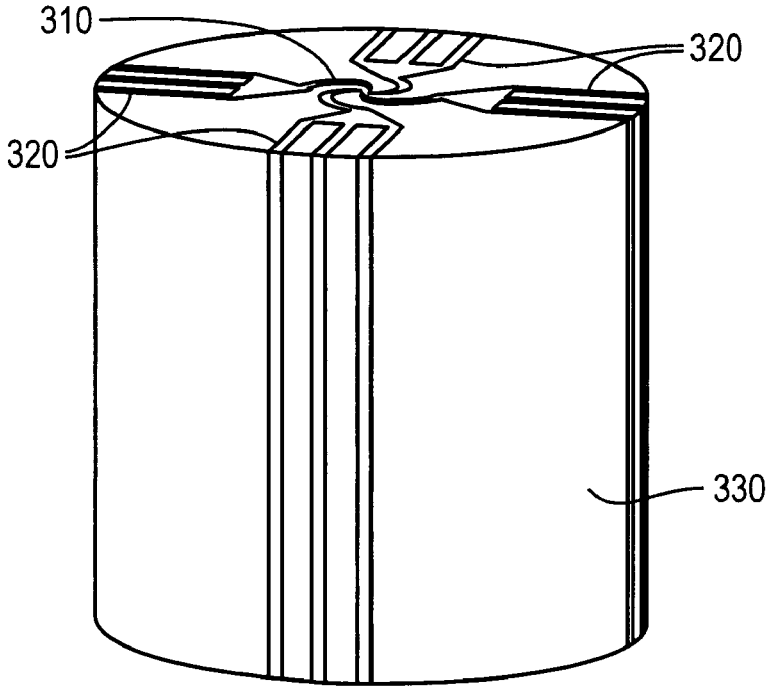
FIG. 3B is a side view photograph of the antenna system of FIG. 3A.
Figure 3C:
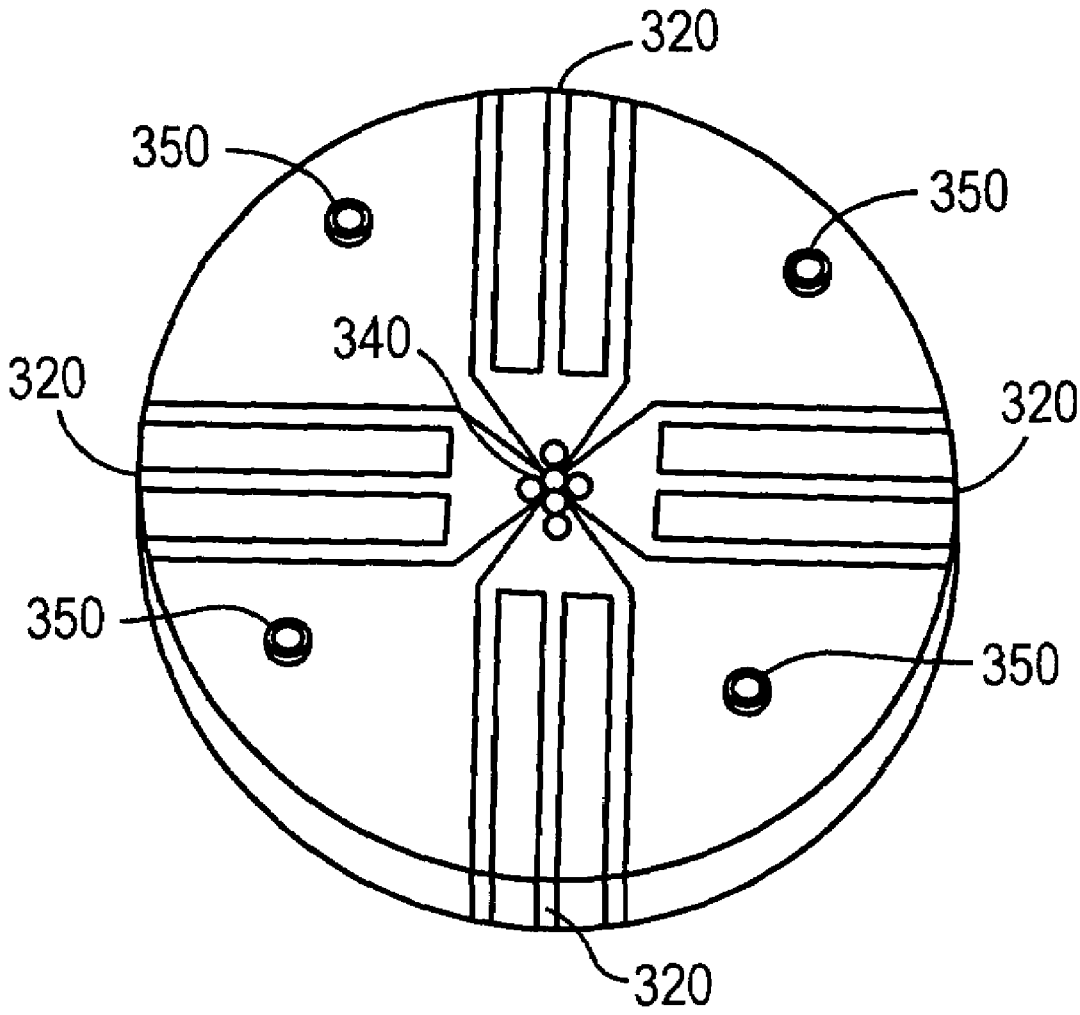
FIG. 3C is a bottom view photograph of the antenna system of FIG. 3A.

FIGS. 3A–3C show photographs of an embodiment of the antenna system with an array supported by a solid buoyant foam material. FIG. 3A shows a top view of the antenna system, FIG. 3B shows a side view, and FIG. 3C shows a bottom view. In this embodiment, the antenna system includes an antenna array and a support for the array (i.e. a foam support). The configuration of the antenna is similar to that shown in FIGS. 1A and 1B.

FIG. 3A shows a top view of the antenna array and support structure. The array includes a quadrifilar spiral element 310 and four filar elements 320, with the spiral element 310 and the top portion of the filar elements 320 arranged horizontally on the top surface of the support structure 330. In this embodiment the spiral element 310 has a diameter of about 2.5 inches, while the overall antenna array (and support structure 330) has a diameter of about 10 inches. The support structure 330 is a solid foam structure that allows the array to maintain the required configuration while being light enough to enable the antenna system to float on the surface of a body of water. In alternative embodiments, other non-conductive, lightweight materials are used instead of the foam structure.

FIG. 3B shows a side view of the embodiment of FIG. 3A. It can be seen that upon reaching the outer edge of the cylindrical support structure 330, the four filar elements 320 bend 90 degrees and extend vertically down the sides of the support structure 330, lying flush with the outer surface of the support structure 330. In this embodiment, the support structure 330 is constructed from a number of separate sections that are connected together to form a cylinder of the required height. In alternative embodiments, the support structure 330 can be constructed from a single piece of material, or a number of differently sized blocks and/or different materials. The height of the antenna array (and support structure 330) pictured is approximately 11 inches.

FIG. 3C shows a bottom view of the embodiment of FIG. 3A. On the bottom of the support structure 330, the four filar elements 320 extend horizontally toward the central vertical axis. The four filar elements 320 can be connected to a number of connection elements 340, that may, in turn, connect the antenna array system to the electronics (not in photos). Four support struts 350 are located on the bottom of the antenna system 300. These struts can be used, for example, to hold the connection element 340 off the ground when storing or performing maintenance on the antenna system 300. The support struts 350 may also be used as guides when attaching another section of support structure to the bottom of the antenna system 300. The additional piece of support structure, for example, may add additional buoyancy to the antenna system 300, and/or may hold and protect the required electronics in a housing below the antenna system 300.

Figure 4:
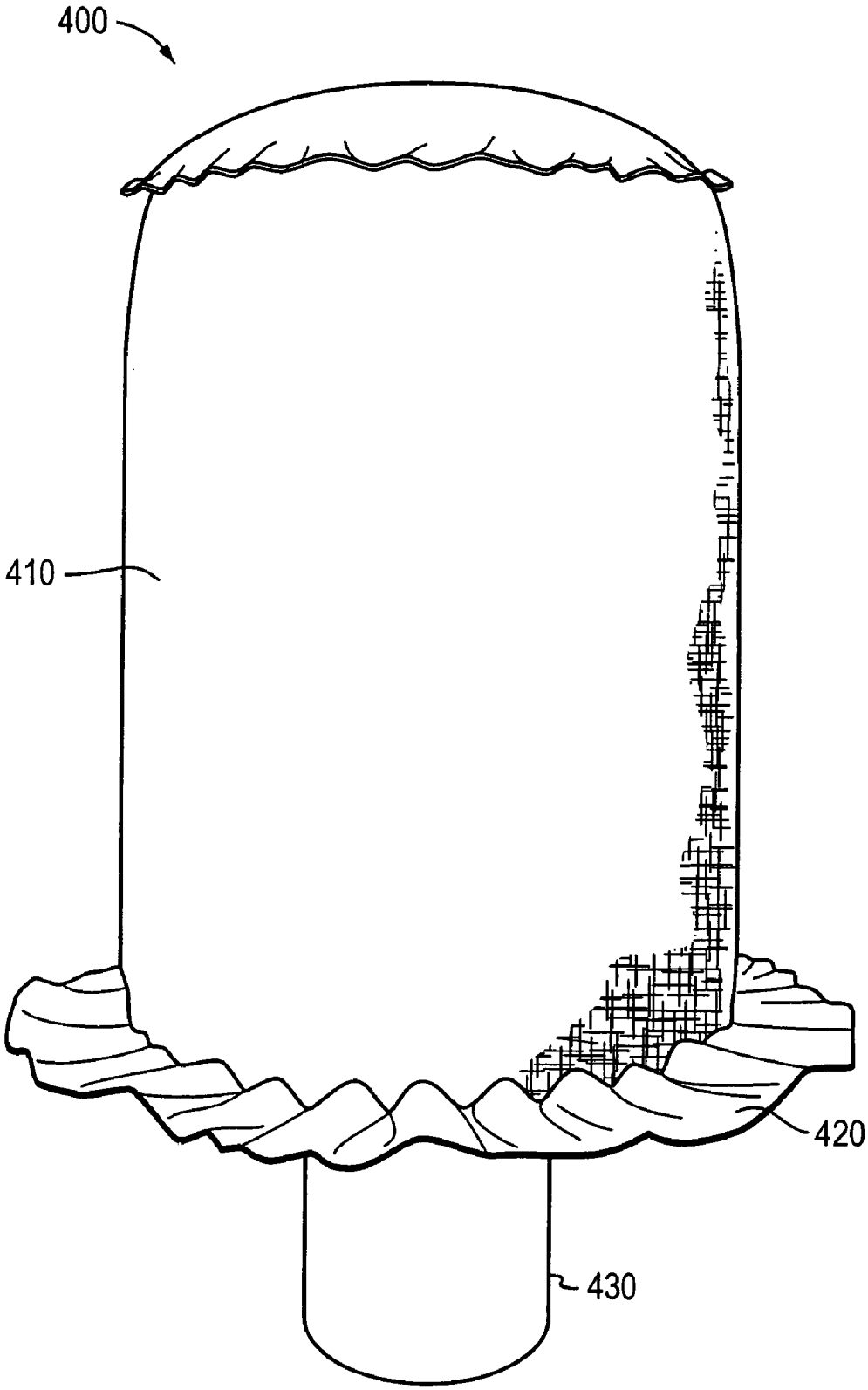
FIG. 4 is a side view photograph of an antenna system with an antenna array positioned within an inflatable housing, according to an illustrative embodiment of the invention.

FIG. 4 shows an embodiment of the invention housed in a flexible, inflatable structure. In this embodiment, an antenna array is imbedded in an inflatable housing 410. Upon inflation, the inflatable housing 410 forms a substantially cylindrical shape, with the antenna array embedded within this cylinder. A skirt 420 at the bottom of the inflatable housing 410 is located approximately at the water surface level when the system is deployed in a body of water. An electronics housing 430 is located within a watertight compartment underneath the inflatable housing 410 to connect to the imbedded array and further provide stability to the structure.

Figure 5:
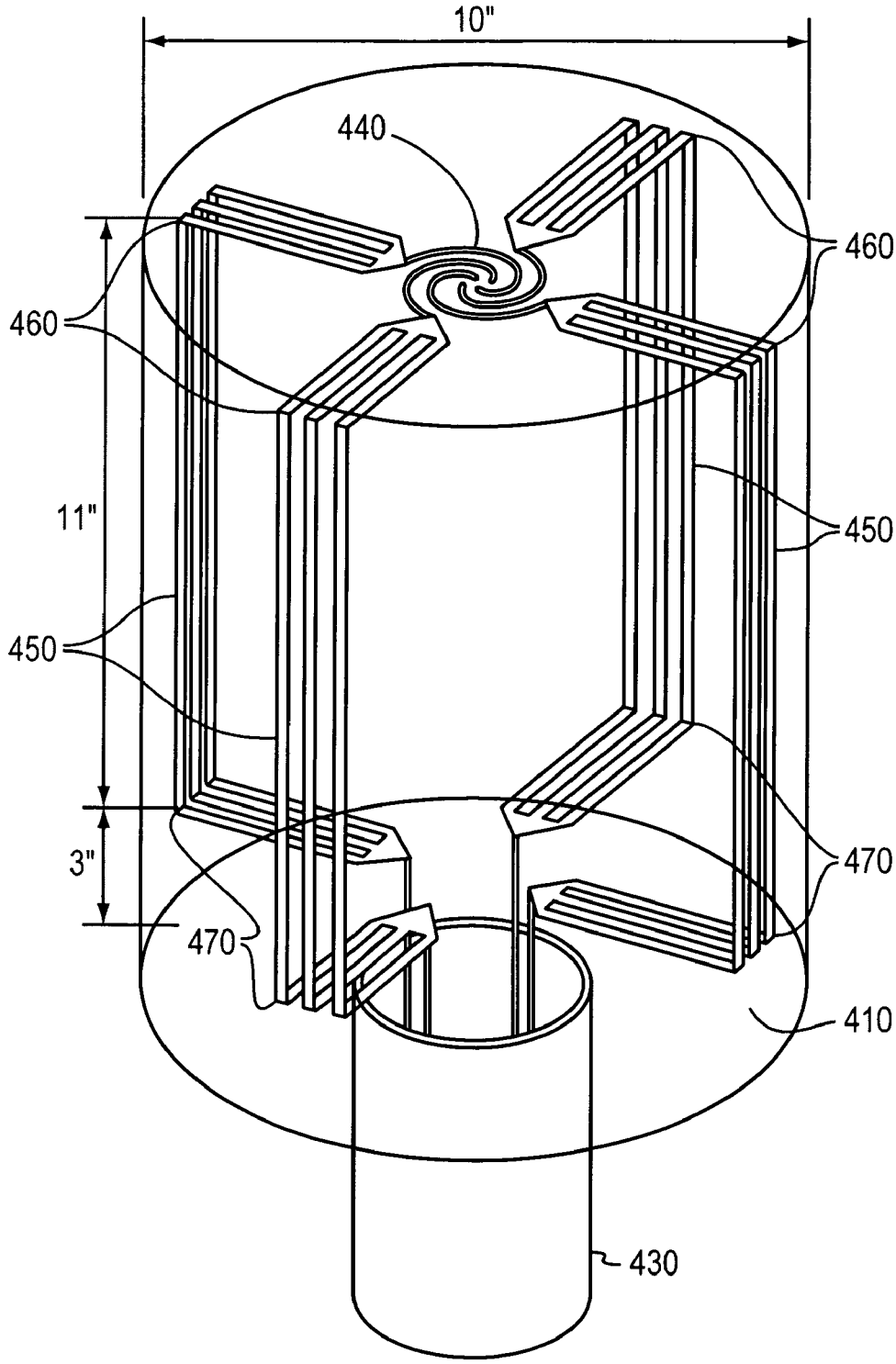
FIG. 5 is a schematic perspective view of the antenna array of FIG. 4.

FIG. 5 shows an interior schematic view of the antenna array imbedded in the inflatable housing of FIG. 4. The antenna consists of a waterproof inflatable housing 410, that can be placed in the water and float such that the bottom of the array is maintained at a substantially constant height. In this example, the bottom of the array is located about three inches above the water level. The array is of the form described in FIG. 1A, with the flexible antenna array including a quadrifilar spiral element 440 and four filar elements 450. An electronics housing 430 is located at the bottom of, and sealed to, the inflatable housing 410, with the electronics housing 430 including a waterproof and airtight bag connected to the inflatable housing 410. The matching networks and required electronics are held within this electronics housing 430. In this example, the inflatable housing 410 that supports the flexible antenna 400 is approximately 10 inches in diameter and fourteen inches tall and may be fabricated from a nylon twill material backed with polyurethane, or other suitable material, which allows the sections of the bag to be heat sealed together. A seal located between the bag and the electronics housing provides the mechanical attachment of the bag and housing to form an air tight structure.

Four tabs may be located ninety degrees to each other at the top interior corner of the inflatable housing 410 to provide upper support to the flexible antenna array at the locations where the filar elements 450 bend 460. Four additional tabs may be located at the bottom corners 470 of each filar element 450, about three inches above the water line, to provide support for each filar element 450 at the 90 degree bend at the bottom of the array. The antenna array pictured defines a cylinder having a diameter of about 10 inches and a height of about 11 inches, the bottom of which is located about three inches above the water line. A non-conductive ring may be located in the center of the inflatable housing 410 at a height of about 3 inches. This non-conductive ring allows the antenna elements to turn 90 degrees downward toward the matching networks and associated electronics located within the electronics housing 430. In an example embodiment, the connector elements from the antenna array to the electronics are made from the same material as the array itself (e.g., copper), and may be from about 5 to about 6 inches long.

The electronics include a matching network to allow for maximum power transfer, thereby increasing the gain of the antenna. In certain embodiments, the electronics may also include a power amplifier and/or other devices. In certain embodiments, the matching network achieves Voltage Standing Wave Ratios (VSWR's) ranging from 2.8:1 to 3.4:1. In further embodiments, a new matching network design is able to provide VSWR's on the order of 2.1:1. This may reduce loss at some frequencies by as much as 1 dB. In certain embodiments, lower VSWR's and associated loss may be achievable.

In one embodiment, the antenna system is adapted to operate at least over a 250 MHz to 270 MHz receive band and a 290 MHz to 310 MHz transmit band. Of course, operation over different receive and/or transmit bands is also contemplated.

In one embodiment, the antenna system includes a bottom-fed four port turnstile antenna array with an integral RHCP open ended quadrifilar spiral element located at the top. The antenna may be configured for VHF/UHF RHCP communication and LOS Communication with the antenna housed within an inflatable float bag similar to that used with the existing submarine UHF Satellite communications buoy, such as an AN/BRT-6 UHF transmit only antenna. Comparing results with those of an existing AN/BRT-6 System, RHCP gains over the UHF SATCOM (Satellite Communications) band (i.e., 250 MHz to 270 MHz receive and 290 MHz to 310 MHz transmit bands), utilizing a 10 inch diameter by 11 inch height volume, is increased. UHF receive capability is also added, with the possibility of operating at higher data rates of 32 kbps. The invention also provides improved axial ratio performance, and improved broadband gain performance above 10 degrees elevation.

Various possible configurations and/or sizes of elements of the antenna (with or without support) include those described with respect to the antenna system described herein above. It should be understood that alternative embodiments, and/or materials used in the construction of embodiments or alternative embodiments, are applicable to all other embodiments described herein.

EXPERIMENTAL EXAMPLES

Experiments were conducted using the antenna systems shown in FIGS. 3A–3C. Electronics for the array were connected to the bottom of the array via a coaxial cable connected to each of the four filar elements. The matching network electronics were embedded in a base layer of buoyant foam material, of substantially the same material as the material supporting the antenna array. The height of the base of the array above surface level was varied by raising or lowering an underwater platform on which the array, foam material, and electronics were mounted. Alternatively, the height at which the base of the array is raised above water level may be varied, for example, by replacing the base layer with a layer of different size and/or buoyancy.

The experiments were carried out by placing the antenna on an underwater support mount in the center of a square salt water tank of dimensions 140 feet by 140 feet. A cavity backed broadband X-Dipole source was suspended on a support above the water tank to provide a known repeatable signal for the antenna to measure. The support defined a path of constant radial distance from the location of the antenna array, starting at ground level and ending directly above the position of the array. As a result, the cavity backed broadband X-Dipole source could be positioned at any angle to the antenna, from directly above the antenna (Elevation=90 degrees, theta=0 degrees) down to substantially water level (Elevation=0 degrees, theta=90 degrees), while maintaining a constant radial distance from the antenna of 66 feet.

Experiments were carried out for a range of angles from theta=0 degrees to theta=90 degrees. Results were also obtained for various array heights above water level. For example, the array was positioned so that the bottom of the array was suspended above the water surface from 0.5 inch to 2 inches. At each of these heights, experimental results were analyzed for four separate frequencies, corresponding to four of the required SATCOM (Satellite Communications) frequencies, specifically 250 MHz, 270 MHz, 290 MHz, and 310 MHz. The antenna was linked to analysis equipment to record and analyze the experimental results.

Experimental results were compared against numerical results from a computer model of the antenna, in this case a Numerical Electromagnetic Code (NEC-4.1 Code Input File) model. A schematic of the antenna array for the NEC model corresponding to the experimental antenna array is shown in FIG. 1B.

Figure 6:
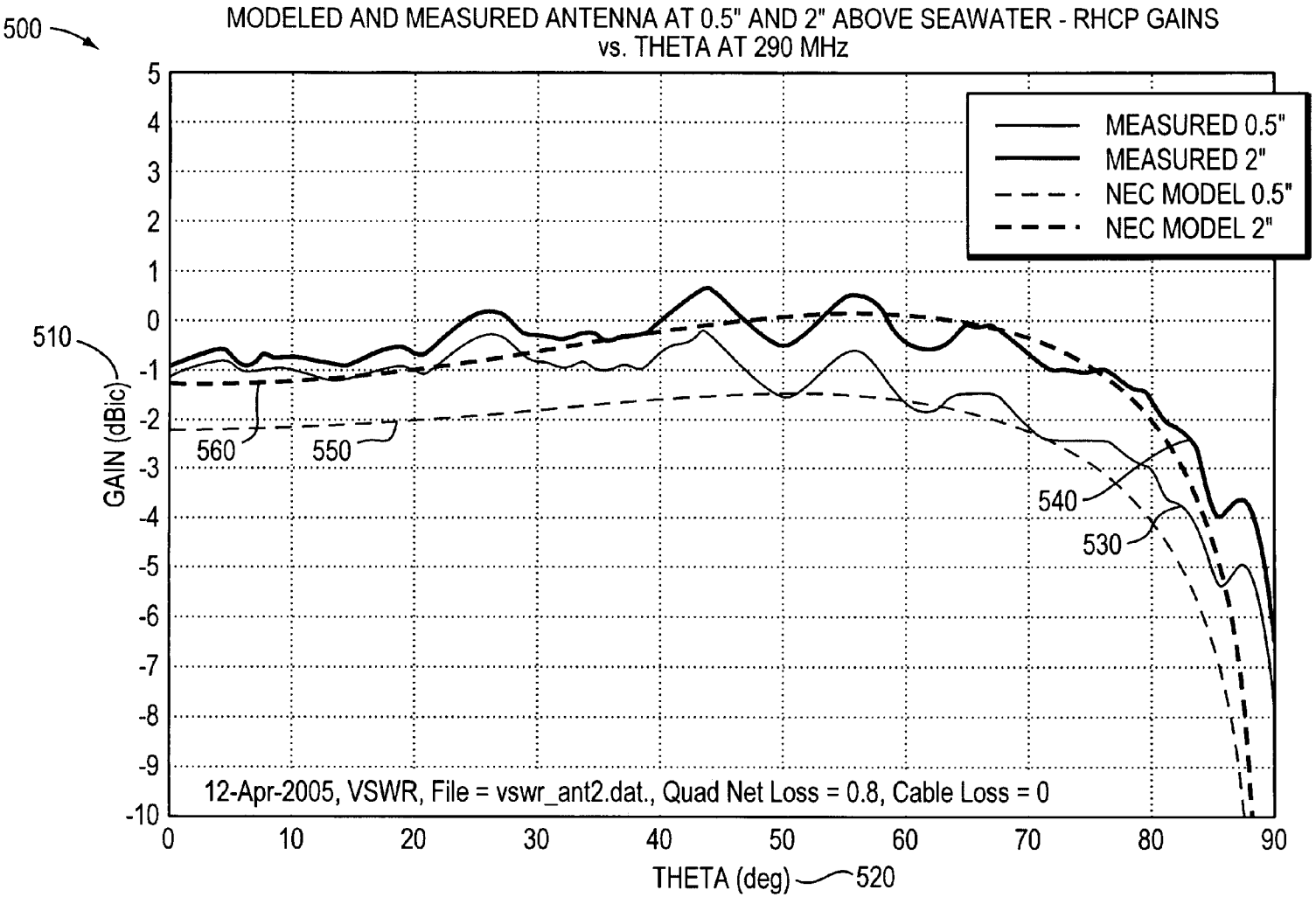
FIG. 6 is a graph of experimental results showing experimental and predicted gain as a function of angle, for the example antenna array of FIGS. 3A–3C.
Figure 7:
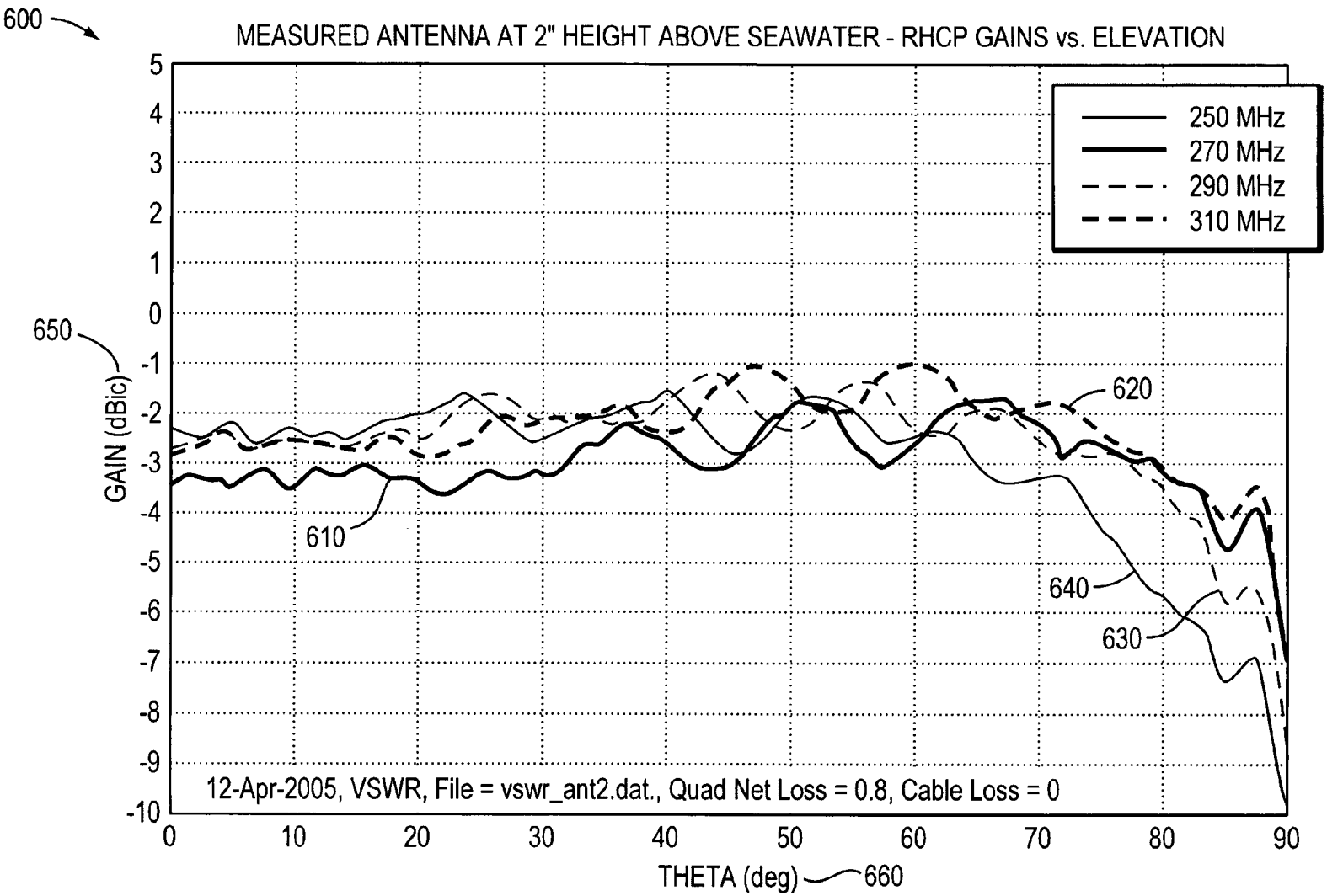
FIG. 7 is a graph of results showing experimental gain as a function of angle for the example antenna array of FIGS. 3A–3C.

Results from the experiments are shown in FIGS. 6 and 7. FIG. 6 shows a graph 500 of Gain (dBic) 510 as a function of the angle from the antenna to the source, theta (degrees) 520. Results for experiments conducted at 290 MHz are shown for an array held 0.5 inches 530 and 2 inches 540 above the water surface. Corresponding NEC model results are shown in FIG. 6 at curves 550 and 560. The actual results compare favorably with model output.

FIG. 7 shows experimental data for an antenna array located 2 inches above the water surface, at each of the four measured frequencies—250 MHz 610, 270 MHz 620, 290 MHz 630, and 310 MHz 640. The graph 600 depicts gain (dBic) 650 as a function of theta 660. Increasing the antenna height above seawater from 0.5 inches to 2 inches improved the gain at most frequencies. The gain was further improved by optimizing the matching network for the actual height above the surface of the water.

Upon further analysis using the NEC model, it was found that a height of about 3 inches above the water level further improves the gain at 10 degrees elevation while not significantly impacting the gain required at 90 degrees elevation. This result is specific to the geometry studied in the above mentioned experiments. Changing the scale and/or shape of the antenna array may result in a change to the optimum height at which the bottom of the array should be located above surface water level. In alternative embodiments of the invention, the geometrical details of the antenna system, including but not limited to the diameter of the spiral section, the outer diameter of the array, the height of the array, and the height of the bottom of the array above the water line, may be modified to best fit the requirements of the system.

EQUIVALENTS

The invention may be embodied in other specific forms without departing from the spirit or essential characteristics thereof. The foregoing embodiments, therefore, are to be considered in all respects illustrative rather than limiting on the invention described herein. Scope of the invention is thus indicated by the appended claims rather than by the foregoing description, and all changes that come within the meaning and range of equivalency of the claims are intended to be embraced therein.

What is claimed is:

1. An antenna system for operation near a ground plane, the system comprising:

an antenna array, the array comprising:

a plurality of filar elements; and a spiral element, wherein at least a first length of each of the filar elements extends radially toward a first point on a central vertical axis and wherein the spiral element is connected to at least one of the filar elements; and a buoyant support for the antenna array.

2. The antenna system of claim 1, wherein the plurality of filar elements comprises four filar elements and wherein the spiral element is a quadrifilar spiral element centered about the first point on the central vertical axis and connected to the four filar elements.

3. The antenna system of claim 2, wherein the spiral element is open-ended.

4. The antenna system of claim 3, wherein the spiral element forms a gap of about 0.2 inch at its center and wherein the spiral element is between about 2 inches and about 3 inches in diameter.

5. The antenna system of claim 2, wherein the spiral element forms a fractional turn.

6. The antenna system of claim 5, wherein the spiral element forms an approximately ¾ turn.

7. The antenna system of claim 2, wherein the spiral element is about 2.5 inches in diameter.

8. The antenna system of claim 1, wherein the antenna array comprises a top and a bottom in relation to a ground plane, and wherein the spiral element is at the top.

9. The antenna system of claim 8, wherein the array is an end-fed array.

10. The antenna system of claim 1, wherein the array comprises a top and a bottom in relation to a ground plane, and wherein the array comprises a first spiral element at the top and a second spiral element at the bottom.

11. The antenna system of claim 10, wherein the array is an end-fed array.

12. The antenna system of claim 10, wherein the array is a center-fed array.

13. The antenna system of claim 1, wherein the support is adapted to inflate upon being deployed from a subsurface position, such that the antenna array is transportable in use to or near a surface of a body of water.

14. The antenna system of claim 1, wherein the array comprises a top and a bottom in relation to a ground plane and wherein the support is adapted to maintain the bottom of the array at a position slightly above the ground plane.

15. The antenna system of claim 14, wherein the position is between about 0.2 inch and about 6 inches above the ground plane.

16. The antenna system of claim 14, wherein the position is between about 2 inches and about 4 inches above the ground plane.

17. The antenna system of claim 1, wherein the support at least partially fills a cylindrical region defined by the array.

18. The antenna system of claim 1, wherein the antenna array is flexible, allowing compact storage prior to being deployed.

19. The antenna system of claim 1, wherein the system is adapted to operate at least over a 250 MHz to 270 MHz receive band and a 290 MHz to 310 MHz transmit band.

20. The antenna system of claim 1, wherein the first length of each of the filar elements is curved.

21. The antenna system of claim 1, wherein at least a portion of the antenna array forms a hemispheric shape.

22. The antenna system of claim 1, wherein the spiral element is connected to each of the filar elements.

23. An antenna comprising:

a plurality of generally C-shaped filar elements orbitally disposed about a central vertical axis; and a first spiral element centered substantially at a first point on the central vertical axis, wherein the first spiral element is open-ended and is connected to at least one of the filar elements.

24. The antenna of claim 23, further comprising a second spiral element centered substantially at a second point on the central vertical axis, wherein the second spiral element is connected to at least one of the filar elements.

25. The antenna of claim 23, wherein the plurality of filar elements comprises four filar elements and wherein the spiral element is quadrifilar.

26. The antenna of claim 23, wherein the first spiral element forms a gap of about 0.2 inch at its center and wherein the spiral element is between about 2 inches and about 3 inches in diameter.

27. The antenna of claim 23, wherein the first spiral element forms an approximately ¾turn.

28. The antenna of claim 23, wherein the first spiral element is approximately 2.5 inches in diameter.

29. The antenna of claim 23, wherein the plurality of filar elements define a substantially cylindrical volume.

30. The antenna of claim 23, wherein the plurality of filar elements define a substantially polyhedral volume.

31. The antenna of claim 23, wherein the plurality of filar elements comprises at least one curved C-shaped filar element.

32. The antenna of claim 23, wherein the plurality of filar elements comprises at least one block C-shaped filar element.

33. The antenna of claim 23, wherein the antenna array forms a hemispheric shape.

34. The antenna of claim 23, wherein the first spiral element is connected to each of the filar elements.

35. An antenna system deployable from a subsurface position for operation near the surface of a body of water, the system comprising:

a flexible antenna array; and an inflatable housing containing the antenna array, the housing adapted to inflate upon deployment from a subsurface position, wherein the antenna array comprises a top and a bottom in relation to a ground plane and wherein the inflatable housing is adapted to maintain the bottom of the array at a position slightly above the ground plane.

36. The antenna system of claim 35, wherein the flexible antenna array comprises:

a plurality of filar elements; and a spiral element connected to at least one of the filar elements.

37. The antenna system of claim 35, wherein the position is between about 0.2 inch and about 6 inches above the ground plane.

38. An antenna comprising:

a plurality of generally C-shaped filar elements orbitally disposed about a central vertical axis; and a first spiral element centered substantially at a first point on the central vertical axis, wherein the first spiral element forms a fractional turn and is connected to at least one of the filar elements.

* * * * *